United States Patent [19]

Mendenhall et al.

[11] Patent Number: 4,874,620

[45] Date of Patent: Oct. 17, 1989

[54] MICROWAVABLE PACKAGE INCORPORATING CONTROLLED VENTING

[75] Inventors: Abraham H. Mendenhall, Morris County, N.J.; Joseph F. Irace; Joseph Skudrzyk, both of St. Louis County, Mo.

[73] Assignee: Packaging Concepts, Inc., St. Louis, Mo.

[21] Appl. No.: 244,279

[22] Filed: Sep. 15, 1988

Related U.S. Application Data

[63] Continuation of Ser. No. 913,964, Oct. 1, 1986, abandoned.

[51] Int. Cl.[4] ..... B65D 30/26; B65D 33/01; B65D 81/34

[52] U.S. Cl. ..... 426/113; 426/107; 426/111; 426/118; 383/101; 383/103

[58] Field of Search ..... 426/113, 112, 107, 234, 426/412, 111, 118, 395, 243; 383/100, 101, 102, 103; 229/DIG. 14, 120, 903, 906; 219/10.55 E, 10.55 M; 206/439

[56] References Cited

U.S. PATENT DOCUMENTS

| | | | |
|---|---|---|---|
| 2,361,344 | 10/1944 | Yates | 426/118 |
| 2,595,708 | 5/1952 | Salfisberg | 406/118 |
| 2,724,543 | 11/1955 | Baver | 383/103 |
| 3,052,554 | 9/1962 | Colman | 229/DIG. 14 |
| 3,261,140 | 7/1966 | Long et al. | 426/234 |
| 3,502,487 | 3/1970 | Byrd | 426/118 |
| 3,512,632 | 6/1970 | Wiggins | 426/118 |
| 3,637,132 | 1/1972 | Gray | 229/DIG. 14 |
| 3,851,574 | 12/1974 | Katz et al. | 426/107 |
| 3,937,395 | 2/1976 | Lawes | 229/DIG. 14 |
| 3,937,396 | 2/1976 | Schneider | 426/118 |
| 3,989,182 | 11/1976 | Stearley | 229/DIG. 14 |
| 3,997,677 | 12/1976 | Hirsch et al. | 426/118 |
| 4,013,798 | 3/1977 | Goltsos | 426/118 |
| 4,206,870 | 6/1980 | De Vries | 426/118 |
| 4,292,332 | 9/1981 | McHam | 426/113 |
| 4,470,153 | 9/1984 | Kenan | 383/101 |
| 4,550,441 | 10/1985 | Keppel | 383/103 |
| 4,567,341 | 1/1986 | Brown | 426/118 |
| 4,571,337 | 2/1986 | Cage et al. | 426/118 |
| 4,596,713 | 6/1986 | Burdette | 426/113 |
| 4,672,684 | 6/1987 | Barnes et al. | 383/103 |

*Primary Examiner*—Steven Weinstein
*Attorney, Agent, or Firm*—Paul M. Denk

[57] ABSTRACT

A microwavable package incorporating controlled venting, including a bag formed of a series of walls, the front, back, side gusseted, and bottom walls, with the walls being of the type formed of a series of laminates constructed of at least a pair of laminar materials, forming at least an inner and outer layer for the structured bag, a vent chamber provided between select of said laminates to afford a controlled venting of the cooking generated pressure and steam from the interior of the bag to its exterior during a cooking process, at least one vent passage provided through the inner laminar material within the region of the disposed vent chamber, said vent chamber extending to the exterior of the bag, whereby during the heating of an item within the bag its generated pressure and steam enters into the vent chamber by way of the vent passage and is released exteriorly of the bag during cooking, while maintaining the integrity of the package and its upper seal during the process.

1 Claim, 3 Drawing Sheets

MICROWAVABLE PACKAGE INCORPORATING CONTROLLED VENTING

This application is a continuation of the application having Ser. No. 913,964, filed on Oct. 1, 1986, and now abandoned.

BACKGROUND OF THE INVENTION

This invention relates to a package for use in the microwaving of cookable items, such as popcorn, other food products, or other substances, and more specifically pertains to the controlled venting of any pressure or steam generated within their container during microwaving to assure that such is effectively released to the atmosphere, preferably without substantially opening of the structured bag, for maintaining the freshly cooked and heated texture for the food product, until the bag is physically opened for consumption or use by the consumer.

A wide variety of controls are known for the cooking of miscellaneous food products within a microwave oven, and more specifically there has been substantial design activity in the fabrication of containers as used for holding particularly popcorn kernels, or the like, during shipment, storage, merchandising, and especially during their microwaving to the edible form.

Examples of these type of prior art containers are shown in the United States patent to Katz, et al, U.S. Pat. No. 3,851,574. This patent, as can be seen, discloses a collapsable bag, structured of paper, or glassine paper, and which incorporates, in its configuration, a central opening that serves as a steam exhaust of restricted size for the purpose of allowing the pressure to be vented that has been generated during microwaving. In addition to the foregoing, the U.S. Pat. No. 4,571,337, to Cage, et al, shows a container and its popcorn ingredient for microwave usage. In this particular container, which appears to be structured very similar to that which is shown in the Katz disclosure, the desired object is to attain venting and release of steam from the container, during microwaving, and particularly through the center strip portion of the shown bag that is located as structured intermediate the formed lateral gussets of the shown container. Hence, as can be seen from these two principal prior art references, which specifically disclose bags or containers for use in a microwave setting, the concept for attaining venting is done simply through providing a separation between a pair of adjacent walls, more specifically at the upper central section of the shown container, and which requires an opening of the main top seal for the bag during microwaving, to achieve their intended results. In fact, an opening of the upper seal is principally what the design of U.S. Pat. No. 4,571,337 intends to achieve. To the contrary, the current invention very precisely controls the venting of pressure and steam from a microwavable bag, by channelling such pressure "through" particular structured wall(s), while maintaining the integrity of the main top seal of the bag even during and after the performance of a microwaving procedure.

Although numerous disclosures have been provided to cover a wide variety of film liners for containers, and the like, and particularly for use in a microwave setting, and which containers incorporate a wide variety of various said liners, in actual practice, the inner liner of film usually employed in the fabrication of such bags has been restricted to the polyester type film, which is obtainable from duPont Company. This is because no other film commercially available is able to withstand the heat of the microwave cooking, and also, other films have a tendency to break away at the top during cooking to provide venting, such as previously explained with respect to the two identified prior art patents. Additionally, although the prior art structures, as previously identified, claim to provide adequate shelf life for their packaged ingredients, in actual practice, the moisture barrier provided by the currently used film, as mentioned, is rather poor in preservation, and as a result, both the marketers and the consumers utilizing such bagged popcorn, or the like, usually overwrap each individual bag with another and separate moisture barrier film such as a polypropylene film, for product preservation and added shelf-life.

Another problem, as previously briefly alluded to, is that in current style popcorn bags available in the art, the seals formed by the films are generally of such weak quality that they tend to release and fully burst open the unsupported top of the bag during the cooking process. In practice, it has been found that the so-called venting alluded to in the previously described patents are in practice actually a function of the polyester film seal strength, and such is generally not controllable and has no flexibility in adjustment with respect to the various types of foods that may be cooked within such structured bags, and in the microwave oven. In addition, the types of foods, the volumes of foods, and the amount of their steam generation and developed internal pressure cannot be taken into consideration during the usage of the type of bags heretofore structured, since their upper seals simply break when exposed to some degree of pressure. Furthermore, with respect to these types of problems, and the lack of proper barrier against moisture permeation, which has led to the supplemental wrapping of such bags by the consumers, such have restricted the type of foods that can be packed in the self-opening style standard bags, as are used in microwaves.

Other U.S. patents disclosing various types of packages for foods include the U.S. Pat. Nos. 2,865,768, to Barnes, et al, 2,673,806, to Colman, 3,689,291, to Draper, 2,189,174, to Hohl, 2,633,284, 3,023,947, 3,052,554, 3,188,215, 3,204,760, 3,293,048, 3,478,952, 3,511,746, 3,851,574, 3,865,302, 3,973,045, 3,997,677, 4,013,798, 4,141,487, 4,145,499, 4,210,674, 4,261,504, 4,292,332, 4,358,446, 4,390,554, and 4,456,164.

It is, therefore, the principal object of the current invention to provide a microwavable bag, which has the attributes of affording both resistance against absorption of the food product or its moisture into the bag, either during storage, application, cooking, or subsequent to heating, while at the same time, providing a moisture barrier against either the entrance of moisture into the bag, which may under usual circumstances cause deleteriousness to the food stored therein, or allow moisture to escape from the food product, causing its desiccation. This invention generally provides a multi-laminar structured bag, having either a paper or polymer outer coating, a moisture barrier intermediate coating, and a non-wicking innercoating which cooperates with further film or adhesive for providing the convenient and proper seals necessary for enclosing and storing the food product therein, until it is subject, sometime later, to microwaving.

Another object of this invention is to provide a microwavable bag which retains its seals, throughout its periphery, even during and subsequent to microwaving, while at the same time, affording controlled venting of its interiorly generated steam and pressure without necessitating any further opening of the bag, other than that which is provided by means of prearranged and structured vent chamber(s) constructed into the bag during its fabrication.

Another object of this invention is to provide a fuller control over the type and style of venting that may be attained for a microwavable package, which can be readily regulated and achieved by a designed fabrication of the bag through a selection of the dimensions for the vent chamber, and its passages, to be structured into the package during its initial assembly.

These and other objects may become more apparent to those skilled in the art upon reviewing the summary of this invention, and upon undertaking a study of the description of its preferred embodiment, in view of the drawings.

SUMMARY OF THE INVENTION

This invention provides for a combination of a standard or near self-opening style bag configuration in conjunction with the materials suitable for microwave application, with the structured bag formed of a combined series of unique laminations that overcome the present day problems of microwave containers as previously depicted and described.

In general, the package or bag of this invention is of a size suitable to accommodate the food to be packaged, and in a shape of the standard self-opening style bag configuration. This normally is a bag which has a series of walls, namely, front and back walls, usually gusseted formed side walls, a bottom wall, all of which are sealed together into permanent closure. The upper portion of the bag is normally sealed into closure, as through heat and pressure sealing, or the like, after the food or other substance to be stored, and eventually cooked, is deposited therein. The bag is primarily made of three plys, that comprising an outer liner for the bag, a middle liner, and an inner liner, all of which will be subsequently described. In addition, in order to enhance the heat sealing characteristics of the bag, a fourth ply, or coating, may be added onto the interior of the inner ply, in order to enhance the heat sealing characteristics of the bag, during usage. Hence, a bag fabricated to these characteristics, which may be formed of three or more plys of film and paper laminates, is rather a substantial change and deviation from the standard two ply bag as currently used in microwave applications, and as explained for the bags of the type ennumerated as prior art.

The various plys of the bag of this invention may be summarized as follows:

The inner ply is one of paper, glassine paper, or a film suitable to withstand the heat generated in the microwave oven when in contact with selected foods, such as popcorn kernels. The inner ply may be generally composed of two layers, such as a Mellinex polyester film, of a crystalline polyester base film, on which an amorphous polyester film has been coextruded. These films are available from I.C.I. Americas, Inc., of Wilmington, Delaware, as an example. The inner ply of paper or film should be nonwicking, and heat sealable, in those required areas proximate the sides, or at the manufacturer's joint for the bag, at its bottom segment, and also along the top edge thereof, which is normally heat sealed into closure after the package has been filed with its contents.

The middle or intermediate ply is preferably formed of a film, or paper, such as glassine paper, or kraft paper, and is suitable to be laminated to the inner ply in such a way as to form the vent chamber(s) as described and defined for this invention. Such a film is a polyester crystalline type, such as Mylar, or a coated paper, such as glassine paper, or a polypropylene. The purpose of these films is to provide a moisture barrier against the migration of moisture into the bag, or exteriorly of the same, but yet remain compatible with the heat requirements of the specific food being packaged, and subsequently heated and cooked by the microwave energy The outer ply of laminar material forming the structured bag is once again a paper, glassine paper, or polymer film, suitable for use in a microwave oven, such as an I.C.I. Americas polyester crystaline film, or a No. 30 or No. 50 machine finished paper available from a wide range of paper manufacturers. Usually, but not necessarily, the paper may be oil/stain resistant treated such as with the type of treatment available under No. FC807, from 3M Company, of Minneapolis, Minn.

This invention during fabrication of the package, causes the lamination between the inner ply and the middle ply to be designed so as to provide the necessary venting, or the vent channel, as previously explained, which is required for this development for affording a controlled release of any steam and/or pressure developed during the microwave cooking process. This is accomplished without the need to use any inferior sealing film, such as that as previously explained, but rather other films, such as the I.C.I. Americas 850 Mellinex, that has been found to have significant seal strength, can be used to keep the entire top and other seals of the bag reasonably closed, during the cooking process, and not be forced open, such as occurs and is necessary for the prior art type of bags. By virtue of the unique design of the vent chamber of this invention, having a series or more of vent passages leading into it, from the interior of the bag, so that steam and pressure can be vented through a formed chimney that is arranged intermediate the inner and middle plys, such affords an area where internal pressure and steam can be control vented from the interior of the bag during the cooking procedure, without necessitating any opening of the structured top seal for the bag. The advantages for this have already been enumerated, but principally the cooked product can remain integrally within the package, retain its freshly heated texture, while the steam and pressure is vented therefrom, so as to prevent, as in the case of popcorn, its from becoming overly moist, and chewy in texture, which detracts from its flavor and appealability. Hence, the controlled relationship in the establishment of the vent chamber(s) intermediate the inner and middle plies, as previously explained, and the dimensions for the structured chamber, has a tendency to allow for a control of the amount and time needed for the release for such internal pressure and steam from the bag during microwaving.

Placement of the vent chamber, with its air passages, arranged respectively adjacent and through a specific location of the inner liner, is preferably arranged in the so-called gusseted area of the package. On the other hand, as previously explained, such controlled venting may also be arranged at the center segment of the structured bag, between its arranged gussets. When the inner ply and middle ply are joined in the manufacturing of the package, as upon calender rolls, they are laminated together through the use of a suitable adhesive. Such an adhesive may be a polymer base adhesive such as urethane polymer, as obtained from Morton Thiokol Company, of Woodstock, Ill. The application of this adhesive is so arranged that it is patterned applied over specific areas between the liners, so as to provide a seal between the liners in all areas except at that location where the vent chamber(s) is designated. Thus, through this arrangement, when the bag is structured from the laminar material, the vent or air space, as formed, is usually arranged extending upwardly through the interior of the bag wall, and generally vents proximate and from the top edge of the formed package, as during bag application. As stated, in conjunction with the laminating process of these two plys together, the manufacturing process causes one or a series of holes or vent passages to be placed at desired locations through the inner ply, overlying the location of the intended vent chamber, and leading into that formed chamber in the area where adhesive was not applied during the inner liner laminating process so as to form that chamber in the first instance. This can be done to the inner ply as it is being calendered towards its location of its lamination with the middle ply, just before the adhesive is applied thereto. During usage of the bag, this then allows for the transfer of the excess steam or air pressure through these vent passages, in the inner liner ply, and to that formed air space providing the vent chamber between the said inner ply and the intermediate laminar material This generally is defined as the nonlaminated area between the inner and middle ply, and which allows the steam to travel up or be vented up through the vent chamber, in a chimneylike effect, and out through the top, side, or bottom of the bag, wherever the vent chamber locates its outlet port for release to the surrounding atmosphere.

Meanwhile, in the structured bag, during its usage, the top heat seal formed along the upper margin of the bag remains completely closed, and is not allowed to be uncontrollably opened at unspecified times during the cooking process. By virtue of the selection of the number of vent chambers, in addition to size and shape of the vent passages through the inner liner ply, the package can provide the food packer with the widest possible variety of choices in conjunction with the type and selection of foods to be packed, and subsequently cooked in the microwave oven.

In addition to the foregoing, this invention also resolves the problem of shelf life. Although as claimed in prior developments that shelf life is attained by virtue of the film used in the formed packages, in actual practice, this is not the case, as stated above. By virtue of being able to select a specific paper or film component for the middle ply, the food producer can at its discretion chose the moisture barrier film such as polyester or polypropylene as desired. Since this film is now sealed and separated from the heat and the food, films of lower heat resistance than the previous polyester type can be used safely without fear of burn-through of the heated food to or through the subject film.

Additionally, this invention does not restrict the use of the outer ply selected to paper alone, or glassine paper, but rather, provides that the outer ply may also be of a film, such as a transparent film, as a polyester, or polypropylene, if so desired. This provides the advantage of improving the esthetics of the back-printed film, and can also incorporate the use of additional barrier films for added moisture, oxygen, or other choice barrier means, depending upon the type of foods being packaged, and the manufacturers needs for the fabricated container. It is believed that this invention clearly opens up the material selection process for the food manufacturer to obtain that enhanced and improved shelf life, and attain that controlled venting during usage, rather than encountering that random breakage of the bag during microwave cooking. It also affords the ability to pack a much wider variety of foods other than popcorn for use in the microwave oven environment The vent chamber effect is unique and provides the venting control selection, depending upon the type of bag manufactured, and through the use of films and papers that can keep the top seal closed during cooking, results in an improved cooking process and eliminates the need to use only one material as the inner liner.

BRIEF DESCRIPTION OF THE DRAWINGS

In referring to the drawings, FIG. 1 provides an isometric view of the calender rolls of film, in this particular instance, the inner and intermediate laminar materials forming the inner and middle layers for the structured bag, and as can be seen, the vent chambers are in the procss of being formed therein.

DESCRIPTION OF THE PREFERRED EMBODIMENT

Figure 2:
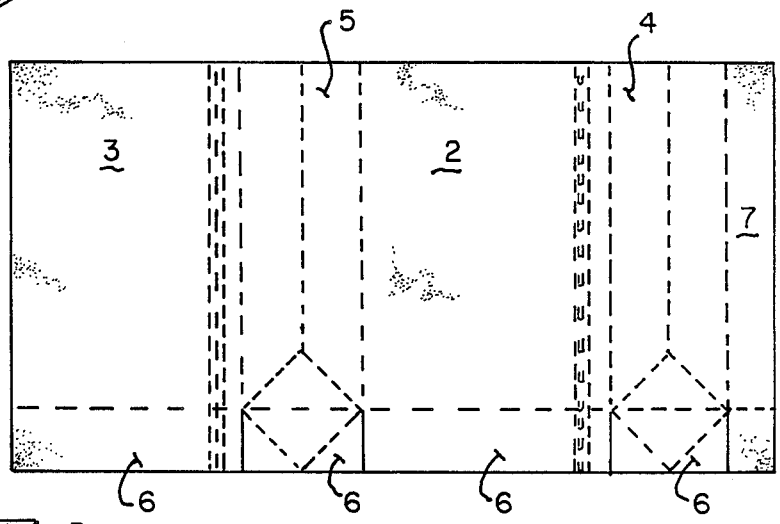
FIG. 2 is a view of a blank formed from the type of laminar material shown in one stage of formation in FIG. 1, disclosing how a gusseted bag, incorporating the teachings of this invention, is provided.
Figure 3:
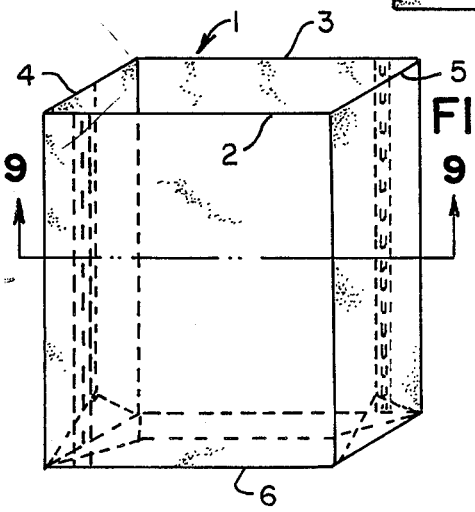
FIG. 3 is an isometric view of a formed gusseted bag, opened at its upper section, showing the arrangement of the vent chambers and passages, in this particular instance, arranged proximate the gusseted areas of the structured bag.
Figure 4:
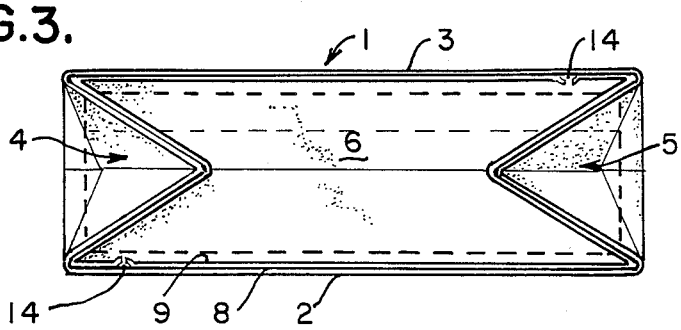
FIG. 4 is top view of FIG. 3, showing the gussets partially folded.

In referring to the drawings, and in particular FIGS. 2 through 4, the microwavable package 1 of this invention, incorporating its controlled venting, is readily disclosed. The package incorporates the usual structure of a bag, having a front wall 2, a back wall 3, side walls 4 and 5, and which may be fabricated of the gusseted design, and with the bag also having a bottom wall 6. These particular components for the bag, and in the blank form, are also depicted in FIG. 2. In addition, a manufacturer's joint, as along the margin 7, is provided for joining the gusseted side wall or panel 4 with the back wall or panel 3. As can also be seen in the blank form, the various bottom panels, denoted at 6, all fold together in the usual fashion to form the bottom wall or panel for the fabricated bag.

Figure 1:
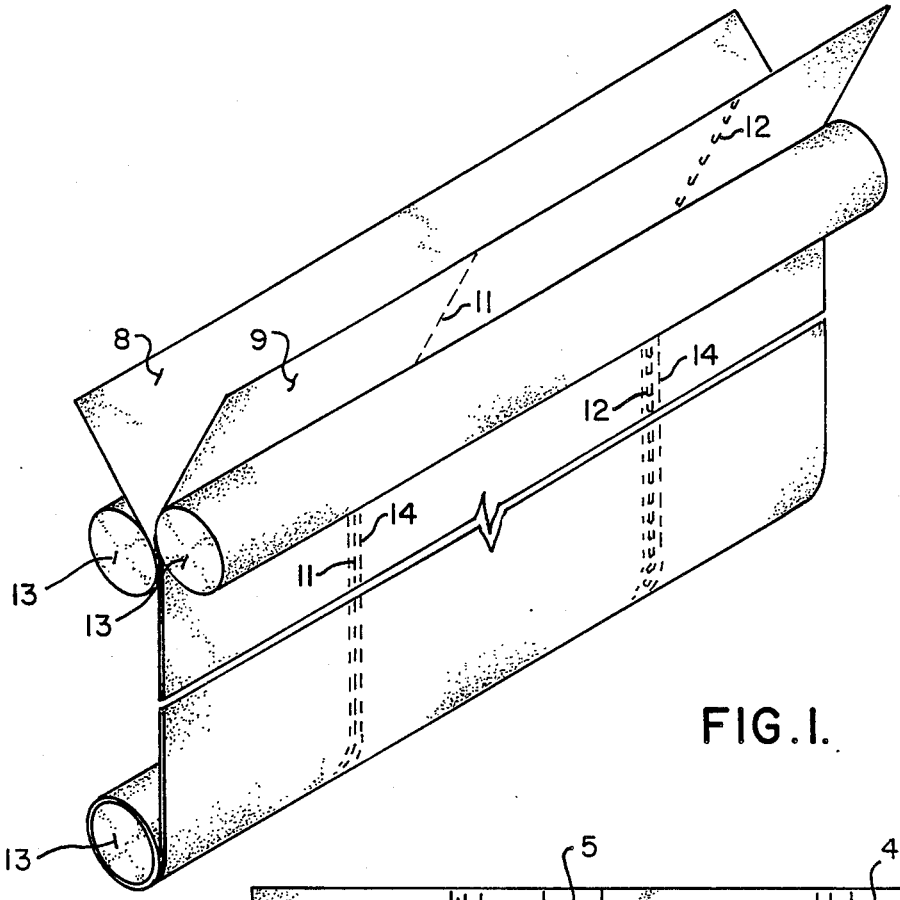
Figure 9:
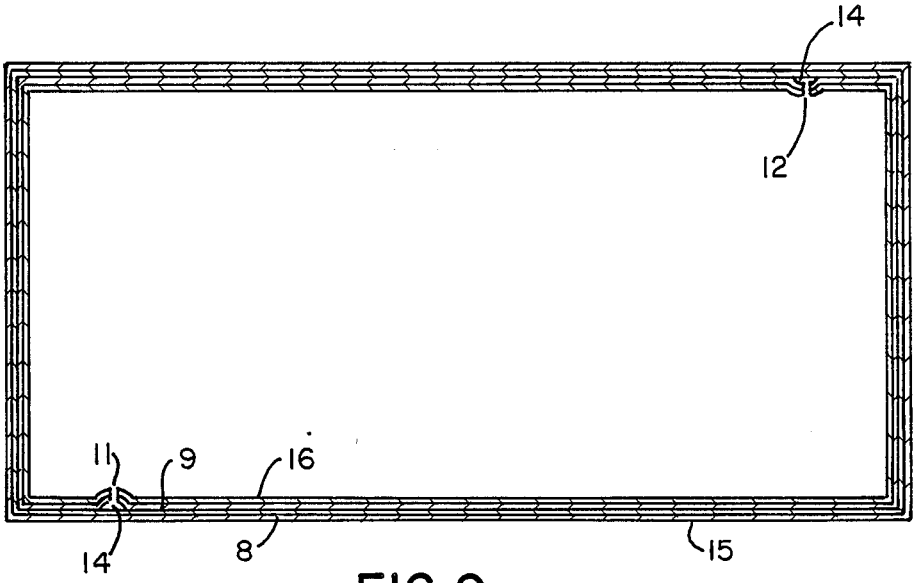
FIG. 9 is a transverse section taken through the bag shown in FIG. 3 and disclosing the various laminar materials forming the structured bag.

In the manufacture of the bag of this invention, and in particular to its blank form, as shown at FIG. 2, various laminar materials are brought together, in the manner as previously described. But, in the formation of the inner and intermediate liners of laminar material structured into the fabricated bag, as can be seen in FIG. 1, the middle liner 8 is brought into contact with the inner liner 9, and a suitable adhesive is applied thereto to furnish adherence of these two liners together. The actual materials forming the liners has previously been described and summarized in this disclosure. As can be seen, as the inner liner of laminar material is fed into the calender rolls, the inner liner will have already been cut along positions to form the intended vent passages 11 and 12 for the invention. These vent passages may be formed by die cutting means severing through the inner liner 9 just prior to its calendering through the rolls 13, as disclosed. In the laminating of the intermediate and inner sheets 8 and 9 together, as previously explained, a suitable adhesive is applied, but it is patterned applied, so that while the adhesive provides for the significant adherence of most of these two laminar materials together, as can be seen in FIG. 1, the patterned application of such adhesive leaves a narrow void, to form the vent channels 14, as depicted. Obviously, there is a planned registration of the passages 11 and 12 in alignment with the formed channels 14, so that, as previously explained, when steam and pressure are generated within the formed packages, such is allowed to pass through the vent passages formed through the inner liner 9, and traverse that channel spacing 14 arranged intermediately of the two said liners 8 and 9. In referring to FIG. 4, the formation of these channels 14 are more accurately shown, albeit rather accentuate, to disclose that clearly there is these formed vent channels 14 arranged intermediate of these two liners 8 and 9, as can be seen. But, very specifically, the details of the laminar material formed package and controlled venting of the gasses and steam pressure generated therethrough, and within the package, is more accurately disclosed in FIG. 9. As shown, the laminar materials forming the bag include the outer liner or laminate 15, and which may be constructed of the type of papers or polymer material and films as previously reviewed in the summary of this invention. Next adjacent to the outer laminate 15 is the intermediate layer 8, which is adhered by an adhesive, or other means, or pressure to the outer layer 15, in a customary manner. This adhesive may be a resin base adhesive, of the type available from Ajax Adhesives, of Chicago, Ill. The inner layer of laminar material includes that inner layer of film 9, as previously analyzed, and which is rolled together with the intermediate layer 8, through a patterned or controlled application of an adhesive therebetween, in order to generally provide for contiguity between these two layers, fully together, except at that location where the application of adhesive is avoided, as at 14, in order to form the vent channels 14, as described. Finally, and as also previously summarized, the inner layer may include a double liner of material, with the inner liner 16 comprising an amorphous polyester film, or other film, which is coextruded with the inner liner 9, and which amorphous polyester film functions as a means for facilitating the heat sealing of the bag into closure, at particularly along its upper marginal edge, after the package has been filled with a food product, such as popcorn, or other substance, in preparation for shipment, heating, and eventual consumption or application, depending upon the nature of the ingredient added into the formed package. As can also be seen, as in FIG. 9, the slits 11, or the U or otherwise shaped vent passages 12, are in communication with the vent channels 14, so as to provide for full communication between the interior of the bag, as disclosed, and to the channels 14, to provide for that controlled venting of steam and pressure from within the interior of the package, during microwaving and heating.

It is to be noted that these vent channels, in addition to their associated passages, are shown in the drawings as being located proximate the side edges or panels of the formed package, and within the region of the bag gussets, when folded, but it is just as likely that these channels could be located within the gussets themselves, as at 4 or 5, or even at a central section of the formed package, and within one or both of the front or back walls 2 or 3, at a central location of the formed package. Also, it is likely that a plurality of such channels could be provided within the structure of the formed bag. In any event, the object of the invention is to provide a controlled means for releasing the pressurized air, whether it be steam or heat pressure that is generated within the package, during microwaving, and yet retain the integrity of the package and its seals, particularly along its upper marginal edge, so as to assure bag closure, even after being subjected to the microwaving process.

Figure 5:
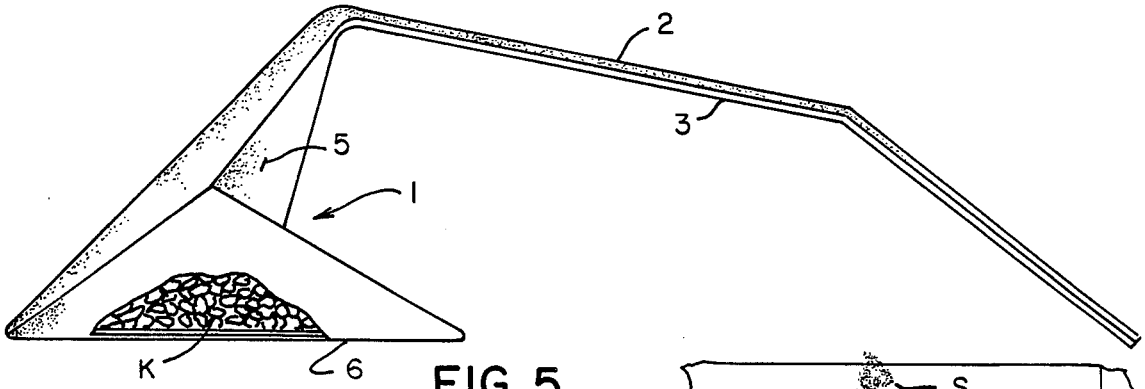
FIG. 5 is view of a structured bag, packaging a food product, probably popcorn kernels in this particular instance, and ready for the microwave oven.
Figure 6:
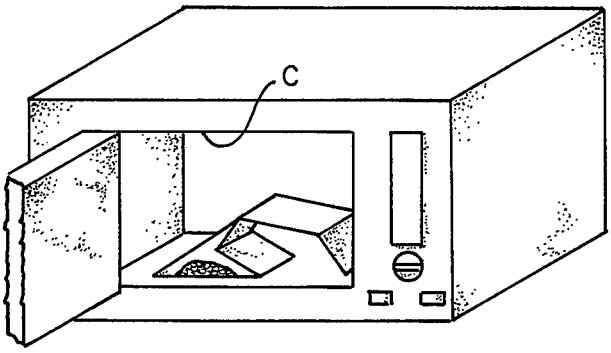
FIG. 6 discloses the bag of FIG. 5 arranged within the microwave oven and ready for cooking.
Figure 7:
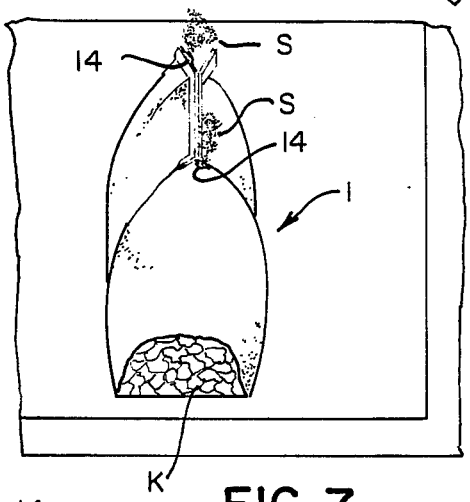
FIG. 7 is a view of the microwavable package, during the process of cooking, wherein its top edge remains sealed during a cooking process, while controlled venting is achieved through the defined vent channels.
Figure 8:
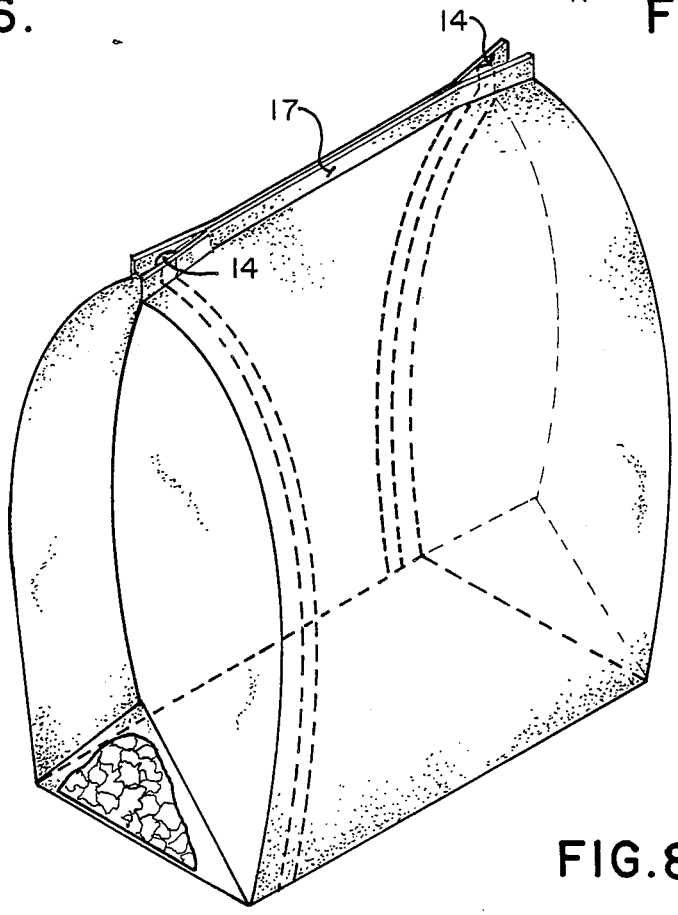
FIG. 8 discloses a cooked food containing package after microwaving.
Figure 10:
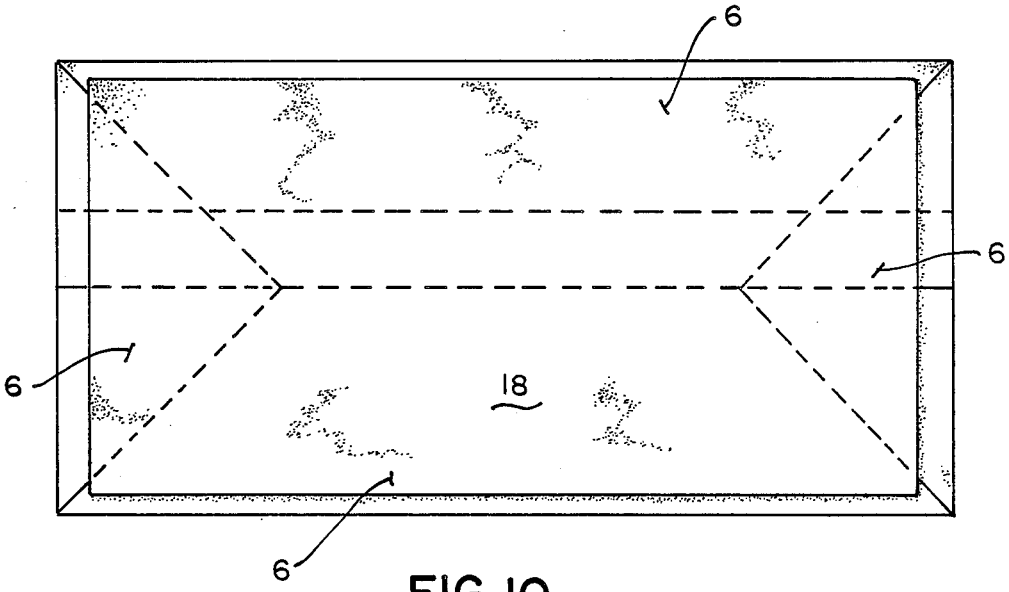
FIG. 10 is a bottom view of the structured bag.

As can be seen in FIG. 5, the bag is disclosed in application. In this particular instance, it is shown having a plurality of food product, such as corn kernels, as at K, located therein, and the bag is folded to provide for a resting of its bottom panel 6 upon a base, such as the bottom of the microwave chamber, as shown at C in FIG. 6. Then, as microwave energy is exposed to the packaged food product, and as can be seen in FIG. 7, in this particular instance, the popcorn kernels begin to expand, into the popcorn texture, and in doing so, expands the bag 1 in the process. But, as can be noted in FIG. 8, even after substantially all of the kernels have popped, and the bag is expanded to its fullest, the upper marginal seam, which has generally been formed by a heat sealing process, through the application of heat bars thereto, remains intact, even though venting has occurred of the steam and internal pressure from the bag through the vent channels, as at 14, in the manner as previously described. In fact, the characterization of the package, as disclosed in FIG. 7, shows the steam S in the process of being vented from the package, through its integral vent channels 14, during the microwaving process, but that even after a cooking procedure has been completed and the cooked food undertakes the configuration within its package as shown in FIG. 8, all the steam and pressure, or substantially all of the steam and pressure, will have been released, but yet the bag remains intact, with its upper sealed edge 17 remaining closed, in order to preserve the freshness of the cooked product. As can be seen in FIG. 8, which is an actual depiction of what the bag looks like after, for example, a batch of popcorn has been popped through microwave application, the bag is rather bulging in its appearance, completely filled with the popped corn, but the upper seal does remain reasonably closed, with all venting having occurred through the vent channels 14. This is achieved by a venting of the steam through those slits 11 and 12, which, as explained, are provided through the entire inner liner 9 for the laminated material, and this is so regardless whether the inner liner 9 may be formed of one or more layers of film, in the manner as previously explained. These vent passages extend totally through that inner liner 9, to achieve a complete access of the steam and gasses to the vent channels 14, to attain a release preferably out of their upper outlet ports proximate the upper edge of the formed bag. While the vent channels may extend all the way downwardly within the structured bag, due to the method of fabrication of the laminar material, as disclosed in FIG. 1, the fold over of the various bottom panels 6 into their closure generally provides a reasonable seal against escape of gasses at this location, or a forced opening of the bottom panel, due to the numerous folds integrally formed therein. This can generally be seen in FIG. 10, wherein the bottom panel is formed of a variety of the panels 6, even those which are folded over in the gusseted configuration, and in addition, there may even be applied an overlying cover, as at 18, to assure the complete and sealed closure of the bottom panel of the bag throughout its extended usage.

Variations or modifications to the subject matter of this invention may occur to those skilled in the art upon reviewing this disclosure. Such variations or modifications, if within the spirit of this invention, are intended to be encompassed within the scope of any claims to patent protection issuing upon this development. For example, it is likely that the teachings of this invention can be employed in a package formed of only a pair of liner materials, having the vent channel(s) being formed or arranged intermediate thereof, for achieving those desired venting results. The description of the preferred embodiment set forth herein, in addition to the disclosure in the drawings, are set forth for illustrative purposes only.

Having thus described the invention what is claimed and desired to be secured by Letters Patent is:

1. A ventable, sealed package containing food to be microwave heated for consumption, said package being capable of allowing said food to be heated in a microwave oven while in said package, said package comprising a bag, said bag comprising a series of walls comprising longitudinally oriented front, back and inwardly folded gusseted side panels, and a bottom panel providing lower closure for the package, and a top sealed edge sealing upper portions of said front and back panels and gusseted side panels together to seal said food between the panels which food is contained therein, said bag and thus each of said panels being formed from the same continuous blank and comprising a laminated sheet comprising a heat sealable and non-wicking innermost layer, an imperforate moisture barrier intermediate layer and an imperforate outer layer, said innermost heat sealable layer having at least one array of a plurality of slits through its thickness, said slits oriented relative to each other longitudinally along the bag between the bottom panel and the top sealed edge at at least one location in at least one of said longitudinally oriented panels, said innermost layer and intermediate layer being laminated to each other over substantially the whole area of each of said longitudinally oriented panels and said bottom panel except in at least one narrow unlaminated area relative to the area of said longitudinally oriented panels which narrow area overlies the array of slits, there being one narrow area for each array of slits, said array of slits forming vent passages allowing gaseous communication from inside said bag to said unlaminated area between said innermost and intermediate layers, said unlaminated area extending longitudinally to said top sealed edge such that said unlaminated area forms at least one vertical channel which opens exteriorly of the bag at the top sealed edge allowing gaseous communication from said vent channel to the exterior of the bag, said top sealed edge comprising opposing portions of said innermost layers of said vertically oriented panels being sealed together to completely seal access to the interior of the bag from the exterior at the top, said at least one array of vent passage slits and said at least one channel between said innermost and intermediate layers dimensioned such that controlled venting of said bag occurs during microwave heating with any internally generated pressure and steam passing through said vent passages into said at least one vent channel between said innermost and intermediate layers and out through said bag at the top sealed edge with said top sealed edge between said opposed sealed innermost layers remaining completely closed.

* * * * *